United States Patent [19]

Dudóme

[11] 4,356,497

[45] Oct. 26, 1982

[54] NON-DISPERSIVE ARRAY ANTENNA AND ELECTRONICALLY SCANNING ANTENNA COMPRISING SAME

[75] Inventor: Michel Dudóme, Paris, France

[73] Assignee: Thomson-CSF, Paris, France

[21] Appl. No.: 299,646

[22] Filed: Sep. 4, 1981

[30] Foreign Application Priority Data

Sep. 9, 1980 [FR] France ..... 80 19413

[51] Int. Cl.[3] ..... H01Q 15/02

[52] U.S. Cl. ..... 343/854; 343/771; 343/895; 343/754

[58] Field of Search ..... 343/754, 854, 895, 770, 343/771, 853, 909

[56] References Cited

U.S. PATENT DOCUMENTS

| | | | |
|---|---|---|---|
| 3,631,503 | 12/1971 | Tang et al. | 343/854 |
| 3,978,484 | 8/1976 | Collier | 343/754 |
| 4,044,360 | 8/1977 | Wolfson et al. | 343/754 |
| 4,185,286 | 1/1980 | Drabowitch et al. | 343/754 |
| 4,297,708 | 10/1981 | Vidal | 343/754 |

*Primary Examiner*—David K. Moore

*Attorney, Agent, or Firm*—Karl F. Ross

[57] ABSTRACT

Non-dispersive array antenna of the prism array type in which the primary dispersive input array and the secondary output array include an acute angle $\alpha$ between each other, made of a piling up of non-dispersive, monodimensional array antennas, in each of which the propagation between said arrays is guided.

Application to electronic scanning antennas of the prism array type.

8 Claims, 6 Drawing Figures

NON-DISPERSIVE ARRAY ANTENNA AND ELECTRONICALLY SCANNING ANTENNA COMPRISING SAME

FIELD OF THE INVENTION

The present invention relates to an array antenna and more particularly to an atenna of the non-dispersive type and small in size. A non-dispersive array antenna is an antenna for which the maximal radiation direction is practically independent of the frequency. The present invention also concerns the application of such an antenna to the realization of an electronic scanning antenna. An antenna array of this type has been described in a copending application now U.S. Pat. No. 4,185,286.

PRIOR ART

Array antennas are known which are non-dispersive, and an array antenna can be cited which is called "candlestick" array antenna in which a first-stage supply channel branches into second-stage supply channels which in turn are branched until a final stage is reached where all the supply channels so obtained are connected to radiating elements acting as individual feeds. Such an antenna structure which includes a certain number of magic T's or dividers is at least complex, space consuming and risks to be heavy as well as expensive.

Another non-dispersive antennas is also known which comprises a supply guide to which are connected, by means of directive couplers, guides which supply the elementary sources, the unit being such that the electric lengths of each supply circuit of an elementary source are equal.

Such antenna, although less space-consuming than the first cited one, has the drawback of being complicated with respect to its mechanical realization which, due to a plurality of elementary sources, i.e. about one hundred, causes again a considerable use of space.

Other non-dispersive antennas can be cited, epecially active lenses and reflecting arrays which are supplied in free space by means of a simple primary source. However, these antennas have the shortcoming that their longitudinal dimensions are equal to the focal length of the system which is considerable. On the other hand, there is a risk of the primary radiation spilling over the periphery of the array which may produce an undesirable diffuse radiation.

Another form of a non-dispersive array antenna has been described in the copending U.S. Pat. No. 4,185,286 which comprises a first dispersive array, feeding a second array the general direction of which makes an acute angle $\alpha$ with the first array; in such an antenna the waves from the first array to the second propagate in free space.

It has been shown for such an antenna, also called prism antenna, that for a frequency $f_o$ of the traveling wave supplying the primary array, the values of the angle between the two arrays as a function of the direction of radiation $\theta_o$ of the primary array are given by the equation:

$$tg\,(\theta_o + \alpha) = -\frac{\frac{K_o}{Kg_o} - \sin\theta_o}{\cos\theta_o}$$

in which $K_o$ is the wave number $2\pi/\lambda_o$ in free space and $Kg_o$ the wave number in the slotted guide forming the primary array at the frequency $f_o$.

FIG. 1 shows this prism array antenna of the prior art in which 1 is the primary linear dispersive array, consisting of a simple slotted guide supplied at its end 2 and with its other end closed with an absorbent load 3. An absorbent panel 8 can be provided on the third side of the triangle having its other two sides defined by the arrays 1 and 4, absorbing the reflected radiation which is related to the active reflection coefficient of the arrays. The secondary array 4, also linear, includes an acute angle $\alpha$ with the primary array 1. In FIG. 1 this secondary array is double-faced, the inner and outer faces of which are formed by radiating elements 5 and 6 of the horn type. Between the two faces of the secondary array, phase shifters 7 are arranged, which interconnected aligned radiators 5 and 6. In the described example, these phase shifters have a fixed value each, and the phase shifts between the successive phase shifters vary linearly from the first to the last phase shifter with the result that the wave radiated by the secondary array has a direction of radiation which is perpendicular to said array. The phase shift to which the wave feeding the secondary array is subjected, has thus the effect of compensating for the phase variation caused by oblique incidence of the primary radiated wave, on the secondary array and thus of determining on the secondary array a stationary phase law.

In the above mentioned patent, the teachings inferred from the monodimensional embodiment of the array antenna have been extended to a two-dimensional array antenna with which electronic scanning is to be carried out.

FIG. 2 shows an embodiment of this array antenna also belonging to the prior art.

The primary array I is formed by a number of slotted guides $9_l$ to $9_n$ similar to the guide 1 in FIG. 1 and each containing the same number of slots 10. All these guides are fed in parallel at one of their ends, by a channel 11. The phase shifters 12 of the electronic type, for example, are provided in cases where it is desired to perform with said antenna an electronic scanning in a vertical plane which is normal to the plane of the figure.

The secondary array IV is formed by a panel 13 comprising a certain number of radiating elements which, in the case described, are rotatable helices 14 fed by dipoles 15. As the rotatable helices 14 allow the phase to be adjusted by turning the heli on its axis, phase shifters like 7 visible in FIG. 1 are no longer required. The third face of the trihedron is an absorbent panel 16, whose function is the same as that mentioned in the cas of the absorbent panel 8 in FIG. 1.

An electronically scanning antenna as the one described has the advantage of being aperiodic to the first order and of not sufferring from masking effect or spillover. Nevertheless, an optimal non-dispersivity of the steering as a function of the frequency is not obtained for all elevation angles. As a matter of fact, upon steering in the elevation plane, the propagation of the wave between the primary array I and the secondary array IV does not strictly occur in the plane of bearing, but in a plane inclined by the value of the angle of the considered elevation angle. Due to this fact, during electronic scanning, there occurs differences in electric length for the waves which propagate between the two arrays, differences which are no longer compensated for by the secondary array.

OBJECT OF THE INVENTION

It is one object of the invention to provide a non-dispersive array antenna structure which does not suffer of the disadvantage set forth above.

SUMMARY OF THE INVENTION

According to the invention, a non-dispersive array antenna comprises a dispersive primary array, constituted by a superimposition of primary, monodimensional arrays, each fed via a phase shifter, a secondary array having the form of a double-faced panel comprising elementary sources on its inner and outer face with passive phase shifters introduced between the two said inner and outer faces, said secondary array including an acute angle $\alpha$ with said primary array, and an absorbent panel constituting the third face of the thrriedron formed with the two other panels, is characterized by the fact that the propagation of the waves between said primary and secondary arrays takes place in guided space by virtue of parallel planes disposed in such a manner that they form the antenna as a piling up of a plurality of elementary, non-dispersive, monodimensional antennas, wherein for each of them the propagation between the primary and the secondary array is guided.

BRIEF DESCRIPTION OF THE DRAWING

Other features and advantages of the invention will become apparent from the following description, given with reference to the accompanying drawings, wherein besides FIG. 1 and 2 relating to the prior art.

DETAILED DESCRIPTION

The preceding description has shown that a monodimensional and two-dimensional prism antenna as well can be realized, with the latter allowing electronic scanning of space.

The main feature of these antennas is that the direction of the maximal radiation is practically independent of the frequency. This feature is related to the fact that the primary and secondary arrays which constitute this antenna include an acute angle $\alpha$ with each other which can be chosen and determined optimally so that the phase of the wave which feeds the secondary arrays is stationary, and the propagation between the primary and the secondary arrays is made in free space.

In operation, such an antenna, especially when it is monodimensional, does not raise problems, except propagation is free or guided, i.e. that in free space, $K_o(Z)$ assumes a value $K_o$ and that in guided space $K_o(Z)$ assumes a value $Kg_o$, except in the case where the polarization vector is vertical and $K_o(Z)$ is the constant of propagation in the guide which constitutes the primary array. This equation is identical to the one given for the realization according to the cited prior art in which the propagation was taking place in free space.

Figure 1:
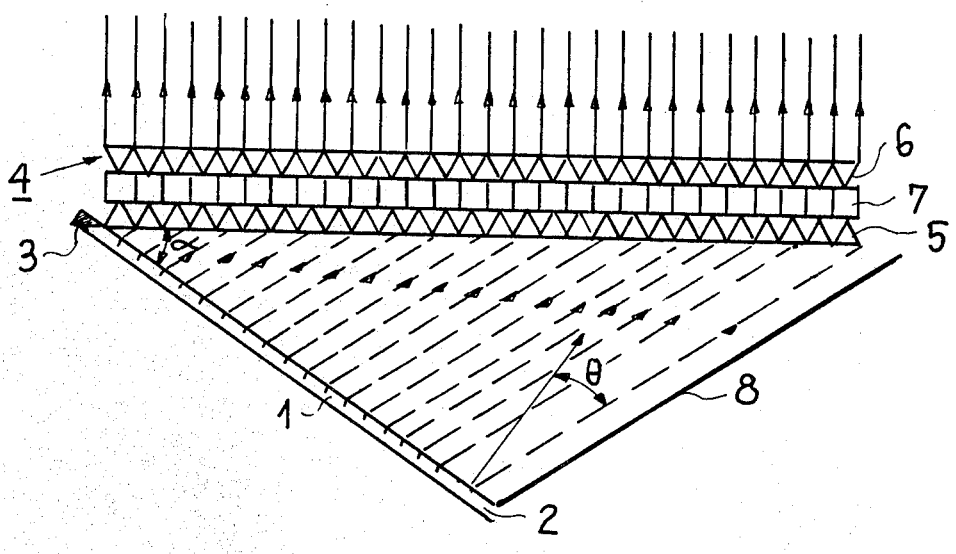
Figure 3:
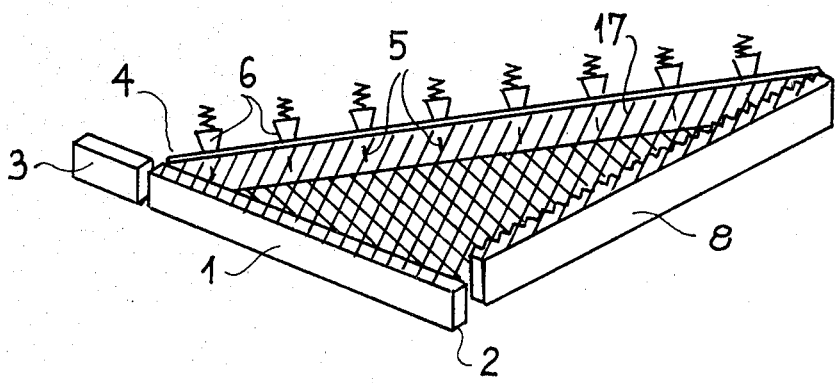
FIG. 3 shows a monodimensional array antenna according to the invention.

FIG. 3 shows an antenna network of the monodimensional type according to the invention. This figure is not very different from FIG. 1 so that the common elements in the two figures have been referenced with the same numerals. For this reason one finds again the primary array 1, fed at its end 2, with the other end being closed by an absorbent load 3, the secondary array 4 with helices 6 as radiating sources in the case of the figure, which helices are fed by the dipoles 5 disposed on the inner face of the double faced array 4. It can be noted that the utilization of rotatable helices allows the suppression of the assembly of phase shifters disposed between the inner and the outer face of the secondary array 4. 17 indicates a plate closing the upper opening of the propagation space between the arrays 1 and 4. An identical plate is found on the other side of the lower opening which cannot be seen in FIG. 3.

Numeral 8 indicates an absorbent load closing the angle between the linear arrays 1 and 4.

It is to be noted that the invention provides a compact module which can be utilized as such as a non-dispersive monodimensional array antenna.

According to the invention, such a module is utilized as an element of a two-dimensional array antenna, with such an antenna being constituted by a piling up of a plurality of these elements. If constructed in this way, such an antenna no longer has the drawback indicated in the case of electronic scanning.

We see from the definition of the prior art that a non-dispersive array antenna with electronic scanning could not be optimally constructed for any value of the elevation angle but only for one value and that upon steering in the elevation plane the compensation of electric lengths in the space of free propagation between the arrays is no longer correctly obtained by the output array with the result of an error in the aimed direction of bearing.

In constructing a two-dimensional antenna according to the invention by a piling up of modules which have been defined above and described in connection with FIG. 3, i.e. modules in which the propagation is guided, it can be noticed that on the level of each module, that is on the level of the horizontal elementary arrays which they constitute in the described example, the phase shift introduced by the phase shifter, arranged at the input of the supply guide of one elementary antenna, is fully retransmitted to the secondary array in such a way that for the antenna assembly the phase law as applied to the phase shifters is fully transmitted in the elevation plane at the output of the secondary array.

Figure 2:
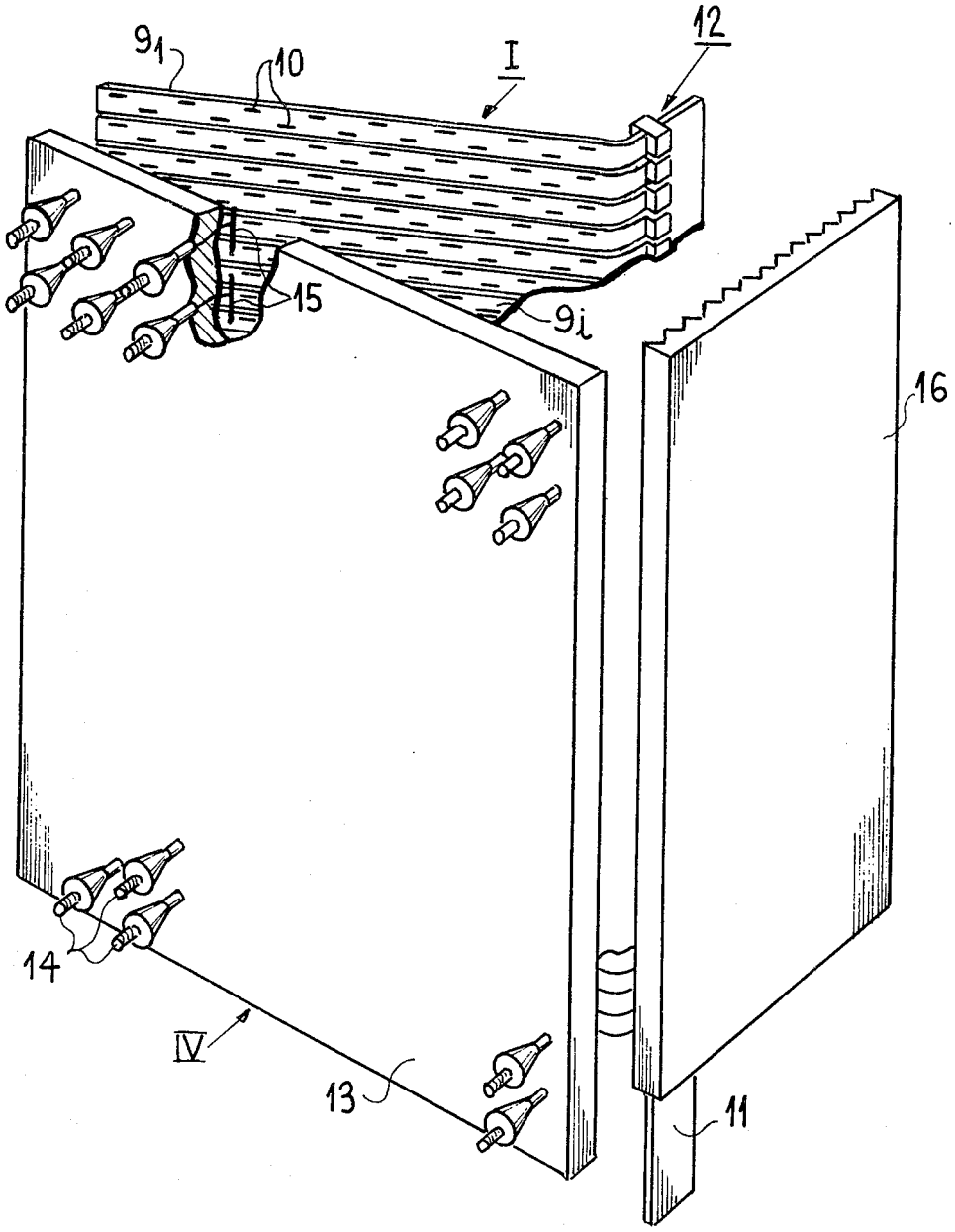
Figure 4:
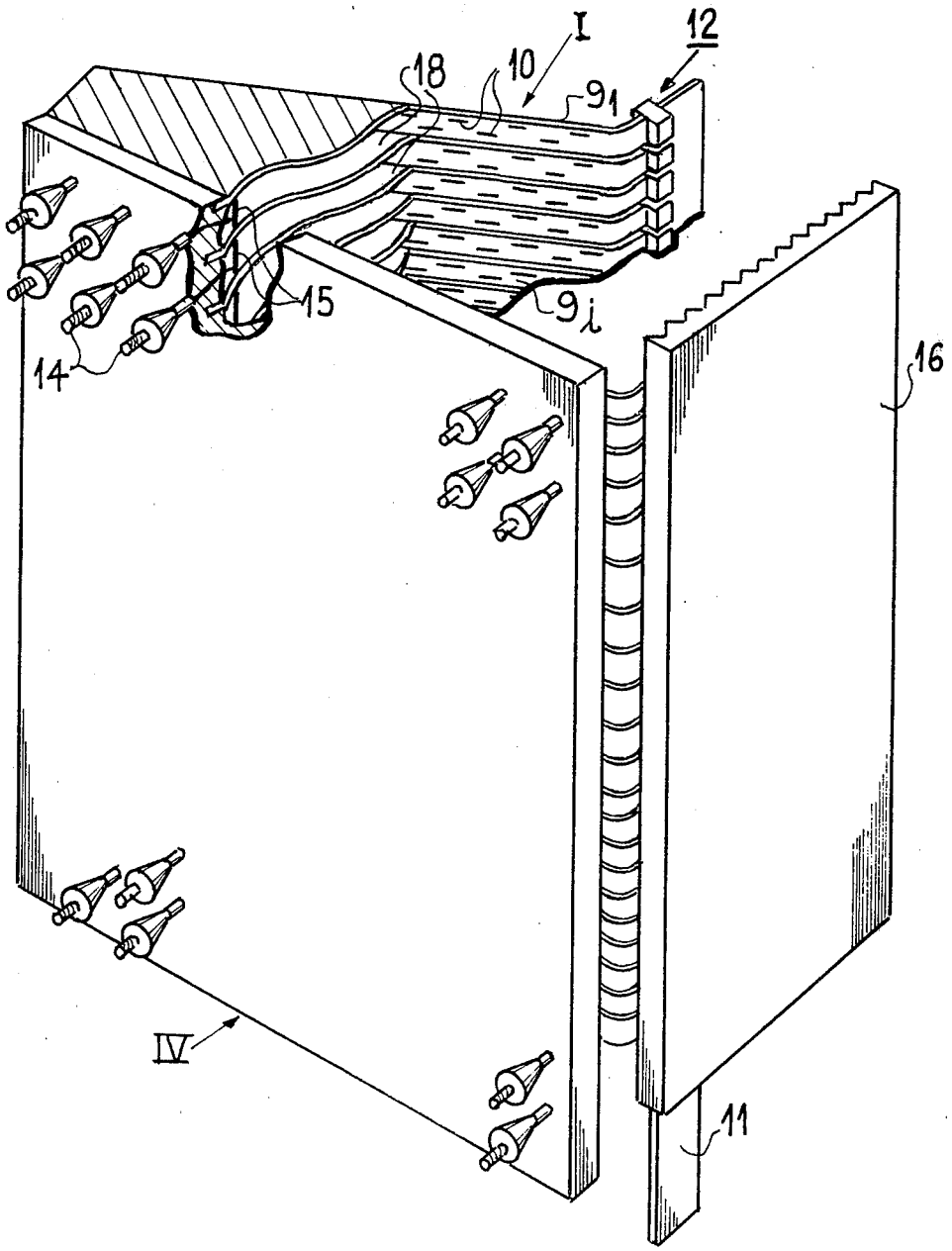
FIG. 4 illustrates a two-bimensional array antenna according to the invention.

FIG. 4 shows a two-dimensional array antenna according to the invention, which representation does not differ much from the one in FIG. 2 where the propagation between the primary and secondary array occurred in free space. Under these conditions, the common parts in the two figures have the same references.

One finds again the panel I, an array formed by a number of slotted guides $9_l$ to $9_n$, with each of them having the same number of slots 10. The input of each of the guides comprises a phase shifter, the assembly of which is referenced by 12 and the supply is assured by a guide 11. The electronic phase shifters 12 allow an electronic scanning in a vertical plane normal to the plane of the figure.

The secondary array IV is formed by a panel 13 comprising a number of radiating elements as rotatable helices 14, for example, supplied by dipoles 15. An absorbent panel 16 is provided to complete the thredrom which constitutes this two-dimensional array antenna. This antenna structure is completed by parallel planes 18 which form, at the inside of the two-dimensional array antenna, the elementary array antennas or modules according to FIG. 3 in which the propagation is guided.

It is noted that in the antenna structure according to the invention in which the propagation between the primary and secondary arrays is guided, the polarization of the waves transmitted is of the horizontal or vertical type; whereas the polarization of the wave leaving the secondary array can be any one, depending only on the radiating elements.

One can also see that in the examples given, the primary array is considered as a slotted guide supplied by a traveling wave. The slots are arranged on the small or the large side of the guide. Accordingly, the primary array can also be composed of radiating elements coupled in any way with a supply line. This line can be a guide but also a line formed by any process of photoengraving, i.e. depositing on a dielectric substrate as in the technology of strip lines, bifilar lines, microstrip or tri-plates. The radiating elements, when they have a plane geometry, can also be engraved on the same dielectric.

These elements can be quarter wave wires, dipoles, half or full waves, yagis, zig-zags, log periodics of flared radiating slot lines.

Figure 5:
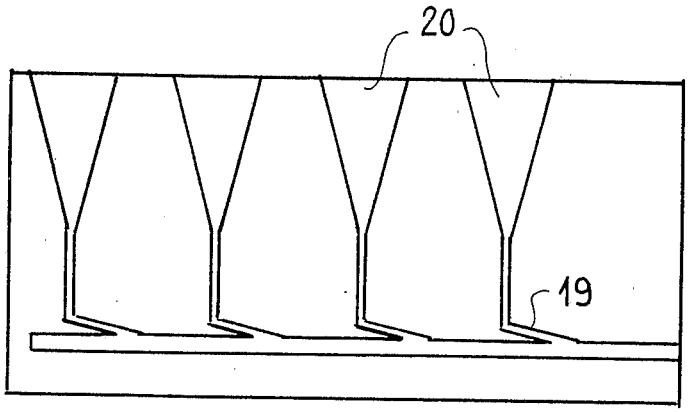
FIGS. 5 and 6 are examples of the primary array, photoengraved in the technology of the micro-strip line.
Figure 6:
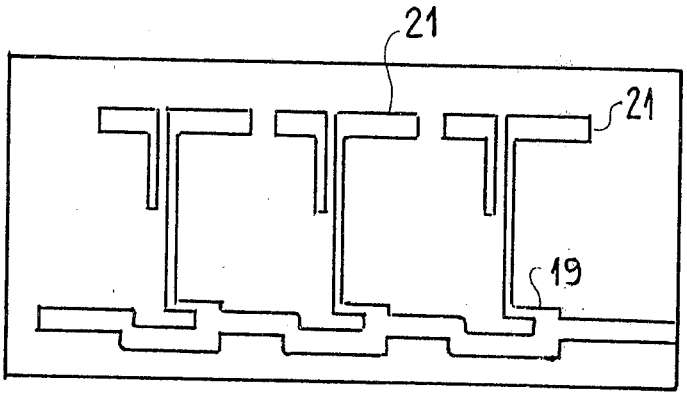

FIGS. 5 and 6 show examples of a primary photoengraved array. FIG. 5 illustrates an embodiment of the technology of slot lines with couplers 19 and flared lines 20. FIG. 6 is an embodiment of the microstrip technology with couplers 19 and dipoles 21.

The inner and outer elements of the output array can be made of any type of radiating elements, photoengraved or not.

If the polarization emitted on the two faces of the secondary array remains the same, the assembly of radiating elements of this secondary array with the passive phase shifters built in therebetween can be made by the metallization of a single dielectric plate. The photoengraved elements are the same as those designed of the primary array.

A non-dispersive array antenna network of small space requirement and reduced weight has been described which operates with electronic scanning made possible by a piling up of a plurality of modules, constituting a non-dispersive monodimensional antenna each.

What I claim is:

1. In a non-dispersive array antenna, comprising a dispersive primary array constituted of a superimposition of primary, monodimensional arrays, each fed via a phase shifter for allowing electronic scanning; a secondary array in the form of a panel having elementary sources on its inner and outer faces with passive phase shifters introduced between the two faces, each such phase shifter aligned with an inner and outer element, said secondary array including an acute angle $\alpha$ with said primary array; and an absorbent panel closing the dihedron defined between the two arrays: the improvements comprising parallel planes arranged between said primary and secondary array so as to provide ducts for guiding the propagation of waves between corresponding radiating elements belonging to said primary and secondary arrays respectively, said array antenna being thus made of piling up of a plurality of non-dispersive, monodimensional antennas, in which the propagation between the primary array and the secondary array is guided.

2. An array antenna as defined in claim 1, wherein each elementary monodimensional antenna forms a compact module which can be optimally reproduced.

3. An array antenna as defined in claim 2, wherein said primary array of a module is a slotted guide supplied by a travling wave, and said secondary array is double-faced with radiating elements on the inner and outer faces and phase shifter means positioned therebetween.

4. An array antenna as defined in claim 1, wherein the secondary array comprises dipoles on the inner face of the array and rotatable helices on the outer face.

5. An array antenna as defined in claim 2, wherein the primary array of a module is a line made on a dielectric substrate by photoengraving, with the radiating elements of the array being engraved on said substrate when they have a plane geometry.

6. An array antenna as defined in claim 2, wherein the secondary array of a module is engraved on a dielectric substrate by photoengraving.

7. An array antenna as defined in claim 1, for which the polarization of the waves entering or leaving the secondary array remains the same, wherein the assembly of the radiating elements of said secondary array and the passive phase shifters positioned therebetween is made by metallization of a single dielectric plate.

8. An array antenna as defined in one of the claims 1 or 2, wherein in the space of propagation between said primary and secondary array the polarization of the transmitted waves is indifferently vertical or horizontal.

* * * * *